United States Patent [19]

Colvin et al.

[11] Patent Number: 4,579,010

[45] Date of Patent: Apr. 1, 1986

[54] SHIFT MECHANISM FOR ENGINE STARTING APPARATUS

[75] Inventors: Jack A. Colvin; Ronald G. Colvill, both of Anderson; Alan L. Smock, Dubois, all of Ind.

[73] Assignee: General Motors Corporation, Detroit, Mich.

[21] Appl. No.: 654,138

[22] Filed: Sep. 26, 1984

[51] Int. Cl.[4] ..... F02N 15/06

[52] U.S. Cl. ..... 74/7 A; 335/131

[58] Field of Search ..... 74/6, 7 R, 7 A; 335/131

[56] References Cited

U.S. PATENT DOCUMENTS

| | | | |
|---|---|---|---|
| 2,302,687 | 11/1942 | Dyer | 290/37 |
| 2,482,534 | 9/1949 | Antoniois | 74/7 |
| 2,542,712 | 2/1951 | Schneider et al. | 290/38 |
| 2,862,391 | 12/1958 | Schneider et al. | 74/7 |
| 4,149,424 | 4/1979 | Bowcott | 74/7 A |
| 4,305,305 | 12/1981 | Mazzorana | 74/7 A |

FOREIGN PATENT DOCUMENTS

| | | | |
|---|---|---|---|
| 859461 | 1/1961 | United Kingdom | 74/7 A |

*Primary Examiner*—Allan D. Herrmann

*Attorney, Agent, or Firm*—C. R. Meland

[57] ABSTRACT

A shift lever mechanism for engine starting apparatus. The mechanism includes a pivotally mounted lever for translating axial movement of the plunger of a starter solenoid into axial movement of a pinion that is adapted to mesh with the ring gear of an engine. The part of the shift lever that is moved by the solenoid plunger has two opposed actuating surfaces that are located at different radial distances from the pivot point of the shift lever. These actuating surfaces are engaged by corresponding surfaces provided on a part movable with the plunger. When the plunger is pulled-in corresponding surfaces separate by an amount sufficient to permit a solenoid switch to open when the solenoid coil is deenergized and the plunger moved to a position to cause reengagement of the separated surfaces.

6 Claims, 8 Drawing Figures

SHIFT MECHANISM FOR ENGINE STARTING APPARATUS

This invention relates to a shift mechanism for translating axial movement of the plunger of a starter or cranking motor solenoid into shiftable movement of a pinion that is adapted to be meshed with the ring gear of an engine to be cranked.

A well known type of starting apparatus for cranking an internal combustion engine includes an electric cranking motor, a pinion that is supported by the cranking motor shaft, a solenoid, including a shiftable plunger and a pivotally mounted shift lever that is connected between the plunger of the solenoid and the pinion. When the apparatus is energized the flux generated by the coils of the solenoid pull the plunger in and movement of the plunger causes the shift lever to pivot which in turn causes the pinion to be meshed with the ring gear of the engine to be cranked. The movement of the solenoid plunger not only shifts the pinion but it also causes a solenoid switch to close to thereby energize the cranking motor.

In the starting apparatus of the type described, a spring is provided that is compressed when the starter solenoid plunger is pulled in and when the solenoid coils are deenergized the spring provides a force tending to pivot the shift lever in a direction to pull the pinion out of mesh with the engine ring gear and in a direction to allow the solenoid switch to open to thereby deenergize the cranking motor.

When the starting apparatus is cranking the engine, that is with the pinion meshed with the ring gear and the cranking motor energized to produce cranking torque, a frictional force is developed between the teeth of the pinion and the ring gear that tends to maintain the pinion meshed with the ring gear as long as the cranking motor is energized. When it is desired to terminate cranking, the solenoid coils are deenergized and the desired result of this action is to cause the pinion to be pulled out of mesh with the ring gear by the spring and the opening of the solenoid switch to open the current path to the cranking motor. The frictional force that is developed during engine cranking is so great that the force developed by the spring is not sufficient to move the pinion out of mesh with the ring gear and if the solenoid switch does not open the cranking motor would be continuously energized in spite of the fact that the solenoid coils have been deenergized.

In order to provide a shift mechanism that will allow the solenoid switch to open after the solenoid coils are deenergized and during a condition of operation where the pinion is being held meshed with the ring gear by the force described, it has been proposed to provide a lost motion connection in the shift mechanism that takes the form of a pin and a slot connection. This pin and slot type of lost motion connection is disclosed in the U.S. patents to Dyer U.S. Pat. No. 2,302,687 and to Antonidis U.S. Pat. No. 2,482,534. In these patents the slot is located in the upper end of the shift lever and the pin is located in the slot and fixed to one end of a link that has a pivotal connection with one end of the solenoid plunger. The pin and slot connection allows the solenoid plunger and the solenoid switch to move to positions that opens the solenoid switch to thereby deenergize the cranking motor. When the cranking motor is deenergized the frictional force decreases to a point where a spring disposed about the shift lever pivot will move the pinion out of mesh with the ring gear.

It is important in the design of a shift mechanism to arrange it such that substantially no clearance between the parts need be taken up when the plunger is being pulled-in to cause meshing of the pinion with the ring gear. Thus, the amount of power or work required to move the plunger to a completely pulled-in position is a function of the power required to move the plunger to a position to take up any initial clearance between the parts of the shift mechanism plus the power required to then move the plunger to a fully pulled-in position where the pinion meshes with the ring gear.

It accordingly is an object of this invention to provide an improved shift mechanism of simplified construction that is arranged such that there is substantially no lost motion clearance to be taken up during pull-in of the solenoid plunger but which nevertheless permits the plunger to move slightly in a retraction direction by an amount sufficient to permit the solenoid switch to open and thereby deenergize the cranking motor when the solenoid coils are deenergized. An important advantage of this arrangement is that the solenoid can be made smaller and lighter since it does not have to take up any lost motion clearance during pull-in of the solenoid plunger.

In a preferred embodiment of this invention the plunger of the solenoid is connected to a part that has two axially spaced surfaces. The surfaces on this part cooperate with a pair of surfaces formed on a pivotally mounted shift lever. The surfaces on the shift lever are at different radial distances from the center of the pivot of the shift lever. At an at rest condition of the solenoid plunger the surfaces on the shift lever are substantially in engagement with the surfaces on the part that is moved by the plunger. As the plunger is pulled-in, the surface on the shift lever that is at the larger radial distance from the shift lever pivot is moved by a corresponding surface on the part connected to the plunger without any substantial lost motion. As the plunger continues in its pull-in movement a space or clearance that progressively increases is created between the surface on the shift lever that is at the lesser radial distance from the shift lever pivot and a surface on the part moved by the plunger. This space or clearance, which is created as the plunger is pulled-in, allows the plunger to move slightly in a retraction direction by an amount sufficient to permit the solenoid switch to open after the plunger has been completely pulled-in and the solenoid coils subsequently deenergized.

IN THE DRAWINGS

Figure 1:
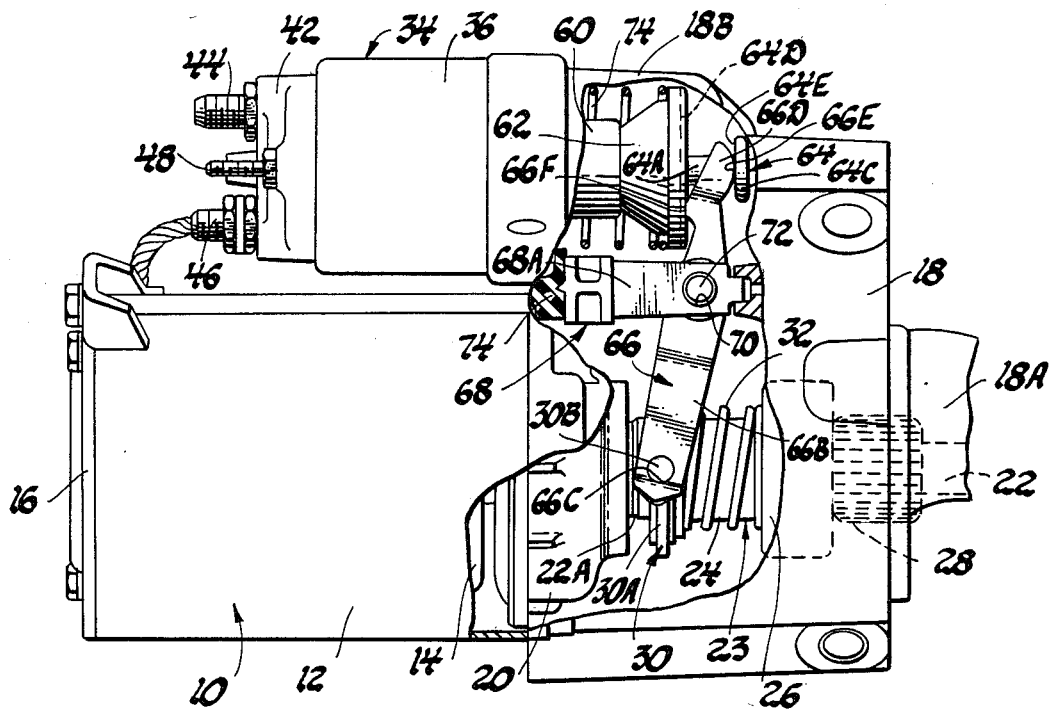
FIG. 1 is a side view, with parts broken away, of an electric starting apparatus that utilizes a shift mechanism made in accordance with this invention.
Figure 4:
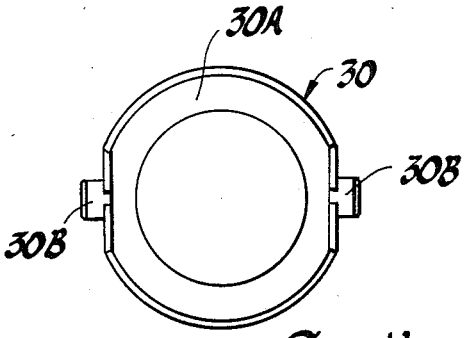
FIG. 4 is a plan view of a collar that is utilized in the cranking apparatus illustrated in FIG. 1.

Referring now to the drawings and more particularly to FIG. 1, an electric starting apparatus is illustrated which utilizes a shift lever mechanism made in accordance with this invention. The electric starting apparatus comprises a direct voltage electric cranking motor generally designated by reference numeral 10. The cranking motor 10 has a cylindrical frame 12 which supports a plurality of circumferentially spaced field flux generating devices which may be field coils or permanent magnets. The direct voltage motor includes the usual rotatable armature 14 that has armature conductors and an armature shaft which is journaled for rotation in bearings which have not been illustrated. The frame structure of the cranking motor includes an end frame 16 and a frame part 18 having a nose housing portion 18A and a portion 18B for supporting a solenoid and for enclosing one end of a shift lever mechanism. The armature shaft, which has not been illustrated, drives a sun gear of a planetary gear set (not illustrated) located in housing 20. The output of the planetary gear set drives a shaft 22 which is journaled for rotation in suitable bearings (not illustrated). The shaft 22 has a larger diameter portion 22A located adjacent housing 20. The shaft 22 supports a starter drive which is generally designated by reference numeral 23. This starter drive includes a sleeve 24 disposed about the shaft 22 and this sleeve and the shaft 22 may have cooperating helical splines of the type that are well known to those skilled in the art. The sleeve 24 is connected to one part of an overrunning clutch 26, the output side of which is connected to a pinion 28 that is adapted to mesh with the ring gear of an internal combustion engine for cranking the engine. The clutch 26 and pinion 28 are supported on driven shaft 22 in a known manner, for example in a manner disclosed in the House U.S. Pat. No. 2,902,125. An annular shift collar 30 is slidably supported by the sleeve 24 and is illustrated in detail in FIG. 4. The shift collar 30 may be formed of a molded plastic material and includes an annular portion 30A and two radially extending cylindrical bosses 30B. The bosses 30B fit within openings in a shift lever in a manner to be more fully described hereinafter. The left end of sleeve 24 carries a split ring (not illustrated) of the type disclosed in the above-referenced House U.S. Pat. No. 2,902,125 that engages the shift collar 30 when it is moved all the way to the left in FIG. 1.

Disposed between the collar 30 and a wall of the overrunning clutch 26 is a jump spring 32 which compresses, in the event of an end tooth abutment between the teeth of pinion 28 and the ring gear of the engine, in a manner well known to those skilled in the art.

The electric cranking apparatus illustrated in FIG. 1 has a solenoid which is generally designated by reference numeral 34 that is attached to housing portion 18B. The solenoid 34 is disclosed in detail in FIG. 6 and includes a metallic housing or case 36 that contains pull-in and hold-in coils that are wound on spool 37. These coils are collectively identified by reference numeral 38.

Figure 6:
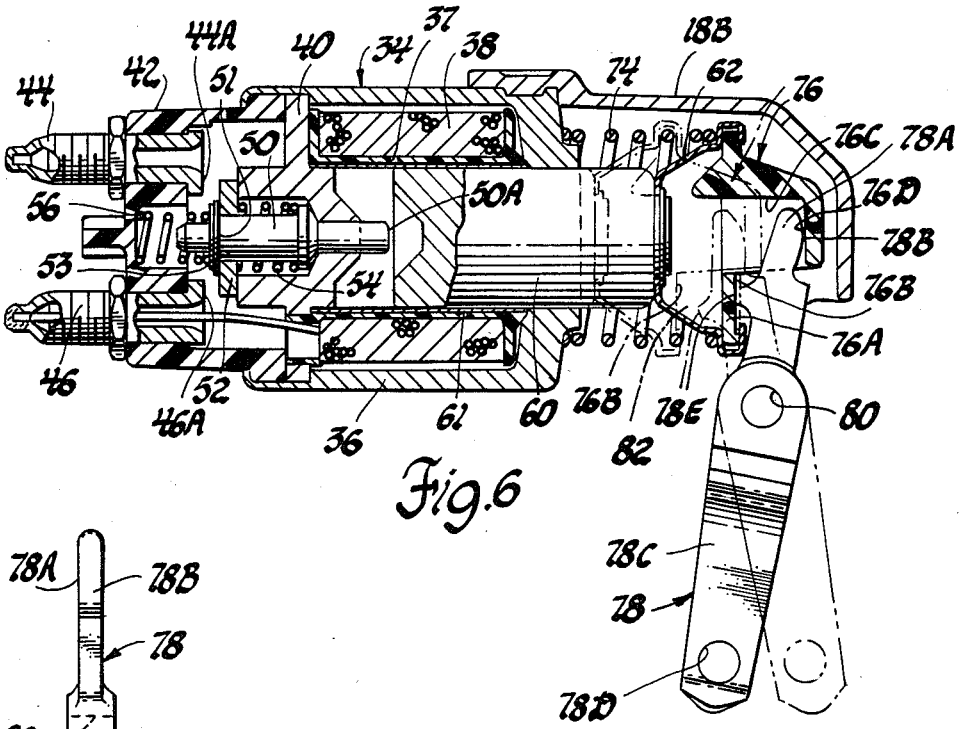
FIG. 6 illustrates a starter solenoid and a modified shift lever mechanism made in accordance of this invention.

The solenoid in FIG. 6 further includes a plunger stop member 40 which is formed of metallic material and an end cap 42 which is formed of insulating material. The end cap 42 is fixed to one end of the tubular housing or case 36.

The end cap 42 carries a metallic battery terminal 44 which has an integral contact face 44A which forms a fixed contact for a solenoid switch that is to be described. In addition, the cap 42 carries a metallic motor terminal 46 that has an integral contact face 46A that forms another fixed electrical contact of a solenoid switch. In addition, and as depicted in FIG. 1, the end cap 42 carries a solenoid terminal 48 which, when connected to the battery of a starting system, energizes the coils of the solenoid.

The solenoid of FIG. 6 has a rod 50 formed of a molded plastic material which is slidably supported by the plunger stop 40. The rod 50 carries an annular copper contact disk 52 which engages the fixed contact faces 44A and 46A when the plunger is moved to the left in FIG. 6. A steel washer 51 is fixed to rod 50 by a fastening device 53. A pair of springs 54 and 56 are provided disposed respectively between end cap 42 and fastener 53 and between a flange on rod 50 and contact disk 52. The end 50A of rod 50 is engaged by the end of a steel solenoid plunger 60 when it is moved to the left in FIG. 6. The plunger 60 is slidably supported in a metallic tube 61.

Figure 5:
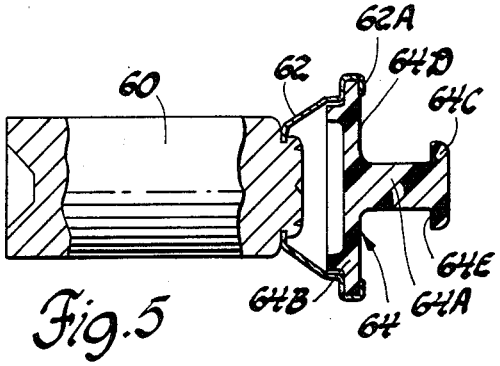
FIG. 5 is a view, partly in section, of a solenoid plunger assembly.

Referring now more particularly to FIG. 5, the steel solenoid plunger 60 is connected to a steel collar 62. The steel collar 62 is fixed to an actuating member generally designated by reference numeral 64 which may be formed of a molded plastic material. The part 64 is fixed to part 62 by rolling over an edge 62A of part 62.

The actuator part 64 has a cylindrical rod portion 64A, an annular portion 64B and a smaller diameter annular portion 64C. The annular portions of part 64 define opposed flat, parallel actuating walls or surfaces 64D and 64E, the purpose of which will be described hereinafter.

Figure 2:
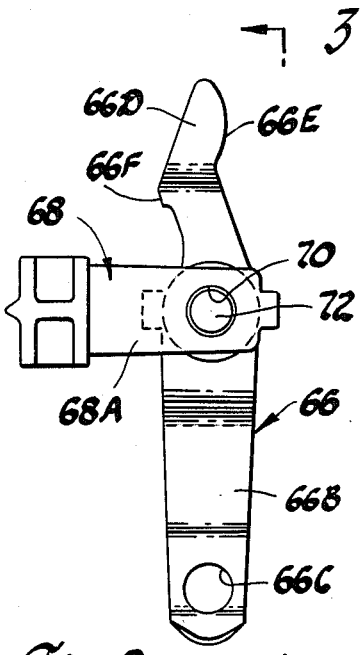
FIG. 2 is a side view of a shift lever mechanism utilized in the cranking apparatus illustrated in FIG. 1.
Figure 3:
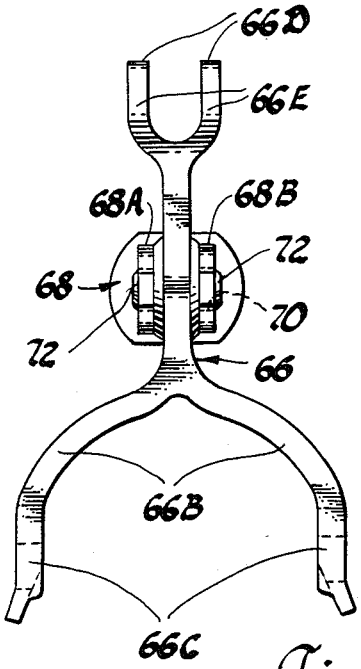
FIG. 3 is an end view of the shift lever mechanism shown in FIG. 2, looking in the direction of arrows 3—3.

The shift mechanism for translating axial movement of the solenoid plunger 60 into axial movement of the starter drive, including pinion 28, comprises a shift lever 66 and a shift lever retainer or support designated by reference numeral 68 both of which are formed of a molded plastic material. The retainer 68 is illustrated in detail in FIGS. 2 and 3 and it has a pair of axially extending laterally spaced arms 68A and 68B, each of which is formed with an opening 70. The openings 70 receive cylindrical bosses 72 formed integral with the shift lever 66 so that the shift lever 66 is pivoted to the retainer 68 about the center of the holes 70 and the bosses 72. It can be seen in FIG. 1 that the retainer 68 is fixed with respect to the fixed frame of the cranking apparatus and is disposed between frame part 18 and a rubber part 74.

The shift lever 66 has a forked lower end comprised of arms 66B and each arm has a hole 66C which respectively receive the bosses 30B of the collar 30. The upper end of the shift lever 66 is also forked and is defined by the spaced arms 66D.

Each of the arms 66D has an arcuately extending surface 66E and a flat surface 66F. It is important to note that the radial distance of the surface 66E, from the center of pivot bosses or posts 72, is larger than the radial distance from the center of pivot bosses 72 to the surface 66F.

In the assembled position of shift lever 66 the rod portion 64A of part 64 is located between arms 66D of part 66. The disposition of cooperating surfaces 64E and 66E and cooperating surfaces 64D and 66F is illustrated in FIG. 1. In an at rest condition of the starting apparatus the surface 66E of the lever 66 substantially engages surface 64E of part 64 and surface 66F of lever 66 engages surface 64D. There may be some slight clearance between surfaces 64E and 66E due to manufacturing tolerances but it is intended that these surfaces be as close as possible when the shift lever mechanism is assembled.

In this at rest condition of the starting apparatus the shift lever 66 is spring biased clockwise by a compression spring 74 disposed between an end of case 36 and retainer 62. The force developed by the spring 74 forces the end of starter drive sleeve 24 against a washer (not illustrated) located between portion 22A of shaft 22 and the end of sleeve 24 and maintains the pinion out of mesh with the ring gear of the engine. Assuming now that the starting apparatus is energized, so as to cause the coil windings 38 to be energized, the plunger 60 will be shifted into a pulled-in position where the left end of the plunger eventually engages the right end of the plunger stop 40. As the plunger 60 moves from right to left in FIG. 1, the surface 64E on part 64 is engaging surface 66E on lever 60 and is pivoting the lever 66 counterclockwise in FIG. 1. There is substantially no lost motion between surface 64E and surface 66E during plunger movement from an at rest condition to complete plunger pull-in. Thus, as the plunger is moved to a full pulled-in position, the surfaces 64E and 66E remain in continuous engagement and there is some sliding contact between these surfaces. As the plunger moves toward its fully pulled-in position it compresses the spring 74. As the lever 66 pivots counterclockwise it causes the collar 30 to move axially relative to the sleeve 24 of the starter drive and exerts a force on the overrunning clutch 26 through the jump spring 32. When the solenoid plunger 60 is fully pulled-in, the pinion 28 becomes fully meshed with the ring gear of the engine. Further, as the plunger 60 pulls-in it shifts the rod 50 to such a position that the movable annular contactor 52 engages the contact faces 44A and 46A, thus completing a current path for energizing the cranking motor.

It is important to note that as the lever 66 is pivoted, engagement is maintained between surfaces 64E and 66E but as the lever 66 pivots the surface 64D progressively moves away from surface 66F. This is due to the fact that the surface 66E is at a greater radial distance from the pivot 72 of the lever 66 than is the radial distance from the center of pivot 72 to surface 66F. As a consequence of this, when the plunger 60 is fully pulled-in there will be a slight space created between surfaces 66F and 64D. The purpose of this space or clearance is to permit the solenoid plunger 60 to move slightly to the right, in FIG. 1, to a position wherein surface 64D becomes reengaged with surface 66F when the solenoid coils 38 are deenergized. Thus, when it is desired to terminate cranking the solenoid coils are deenergized and the spring 74 forces the plunger 60 to the right. The lever 66 is now being held in a fixed position because pinion 28 is being held meshed with the ring gear of the engine. As the plunger 60 moves to the right it will be moved to a position in which surfaces 66F and 64D become reengaged and surfaces 66E and 64E become slightly separated. The amount of travel that is permitted in this retraction direction of plunger 60 is such as to allow the contactor 52 to become separated from the fixed contacts 44A and 46A with the result that the current path to the cranking motor is now broken. The contactor 52 is moved to an open position by spring 56 which also serves to move the rod 50 to the right in FIG. 6. With the current path to the cranking motor interrupted there no longer is a force tending to hold the pinion meshed with the ring gear and as a result the force of the spring 74 is sufficient to shift the lever 66 back to its at rest position, illustrated in FIG. 1, and during this clockwise movement of lever 66 the pinion 28 is pulled-out of mesh with the ring gear of the engine. Further, the lever 66 is moved back to a position in which an end of sleeve 24 engages the washer located between it and shaft portion 22A. It will, of course, be appreciated that when the solenoid plunger moves toward its retracted position, that is to the right in FIG. 1, the surface 64D is applying a force to the surface 66F after the initial clearance between these parts have been taken up.

Figure 7:
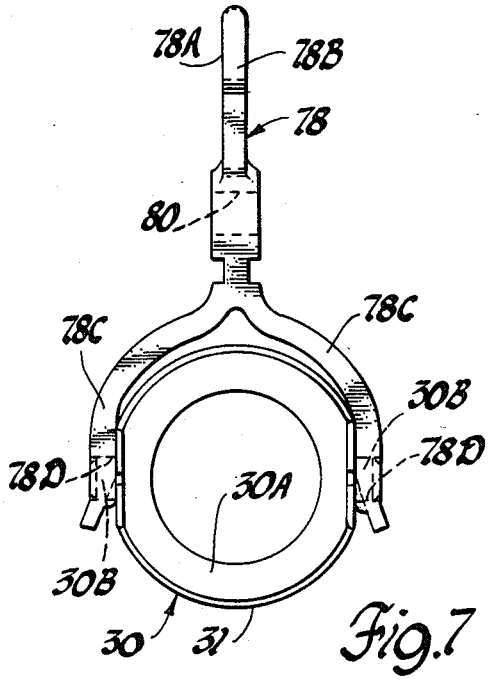
FIG. 7 is a view illustrating the shift lever shown in FIG. 6 and how it cooperates with the collar illustrated in FIG. 4.
Figure 8:
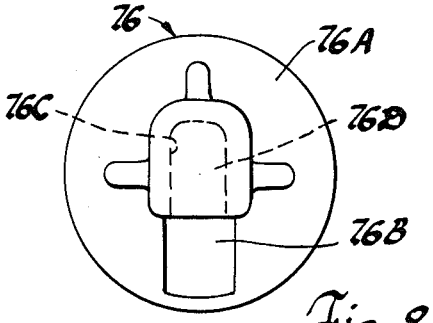
FIG. 8 is an end view of a part of the shift lever mechanism illustrated in FIG. 6.

A modified shift lever mechanism, which performs the same function as the one that has been described, is illustrated in FIGS. 6–8. The same reference numerals have been utilized in FIGS. 6–8 as were previously used in order to identify corresponding parts. It is to be understood that the shift lever mechanism illustrated in FIGS. 6–8 would be substituted for the mechanism illustrated in FIGS. 1–5.

This modified shift lever mechanism includes a part 76 which is formed of a molded plastic material that is attached to plunger 60 by retainer 62. The part 76 has an annular portion 76A, a wall or surface 76B and a recess 76C that has a wall or surface 76D. The walls or surfaces 76B and 76D are flat and substantially parallel to each other.

The shift lever in the embodiment of the invention illustrated in FIGS. 6–8 has been generally designated by reference numeral 78 and includes an upper portion 78A having a curved actuating surface 78B. The shift lever 78 has a lower forked configuration defined by arms 78C, each of which is provided with a hole 78D that receives the cylindrical bosses 30B of the shift collar 30. It can be seen from FIG. 6 that the upper portion 78A of the lever 78 is located within the recess 76C of the part 76. The lever 78 has an opening 80 which receives a metal pivot pin (not illustrated) for pivotally supporting the lever from the housing 18. In this regard, the lever is pivoted to portions of housing 18 that are provided with aligned spaced holes that receives a pivot pin that passes through hole 80. This arrangement has not been illustrated and may be of the general type illustrated in the Hartzell et al. U.S. Pat. No. 2,839,935.

The shift mechanism that has been described performs the same function as that previously described in connection with FIGS. 1–5. Thus, in the at rest position of the plunger 60 the surface 76D of part 76 substantially engages the curved actuating surface 78B of the lever 78 and the flat surface 78E of lever 78 engages the surface 76B of part 76. When the plunger 60 is fully pulled-in to move the part 76 to the dashed phantom line position in FIG. 6 it can be seen that there is space or clearance identified by reference numeral 82 between surfaces 78E and 76B. Thus, as the solenoid plunger pulls-in the surface 78E becomes progressively separated from surface 76B. With the solenoid plunger fully pulled-in and the solenoid subsequently deenergized the spring 74 can move the plunger 60 back to a position in which the surfaces 78E and 76B become reengaged. The amount of clearance or separation, identified by reference numeral 82, dictates the amount the plunger 60 can move in a retraction direction and this space is large enough to permit the fixed contact 52 to become separated from the fixed contacts 44A and 46A to thereby deenergize the cranking motor. The spring 74 now will move the plunger 60 and the lever 78 back to the full line position in FIG. 6 and during this movement the pinion 28 is pulled-out of mesh with the ring gear.

It is pointed out that the radial distance from the center of pivot hole 80 to surface 78B is greater than the radial distance from the center of pivot hole 80 to flat surface 78E. The surfaces 78B and 78E of lever 78 perform the same function as the surfaces 66E and 66F of shift lever 66.

The curved surfaces 66E of lever 66 and 78B of lever 78 are arcs of a circle having a predetermined radius.

In summary, it will be appreciated that the total distance that the plunger 60 must move, as it moves from an at rest condition to a fully pulled-in position, is maintained at a minimum since there is substantially no lost motion between the parts of the shift mechanism as the solenoid plunger pulls-in. This is accomplished in an arrangement that permits the solenoid switch to open after the plunger has been completely pulled-in and the solenoid coils deenergized.

The shift lever mechanism of this invention has been disclosed in connection with starting apparatus that has two shafts and a planetary gear set for transmitting motion between the armature shaft and another shaft. The shift lever mechanism of this invention can also be used with starting apparatus that has only one shaft, that is where the armature shaft supports the starter drive.

The embodiments of the invention in which an exclusive property or privilege is claimed are defined as follows:

1. A shift lever mechanism for translating axial movement of the plunger of a starter solenoid into axial movement of a pinion of an engine starting apparatus comprising, a starter solenoid having an axially shiftable plunger and a coil winding, a spring opposing pull-in movement of the plunger and a solenoid switch operated to a closed condition when the plunger is completely pulled-in, a shift lever actuator carried by said plunger for axial movement therewith, said actuator having a pair of spaced surfaces, a pivotally mounted shift lever one end of which is adapted to be coupled to said pinion, the opposite end of said shift lever having a pair of opposed shift lever surfaces that respectively engage said surfaces on said actuator, the actuator surfaces and the shift lever surfaces being substantially engaged when said shift lever is in an at rest position, the surfaces on said shift lever being at different radial distances from the pivot point of said shift lever and being arranged relative to the surfaces on the actuator such that when said solenoid plunger pulls-in the surface on the shift lever that is at the greater radial distance from the pivot point is moved by a surface of said actuator and the other surface on said shift lever becomes separated by a predetermined amount from its cooperating surface on said actuator, the amount of separation being sufficient to allow said solenoid switch to be actuated to an open condition when said solenoid coil winding is deenergized and said spring shifts said plunger to reengage the separated surfaces.

2. A shift lever mechanism for translating axial movement of the plunger of a starter solenoid into axial movement of a pinion of an engine starting apparatus comprising, a starter solenoid having an axially shiftable plunger and a coil winding, a compression spring opposing pull-in movement of the plunger and a solenoid switch operated to a closed condition when the plunger is completely pulled-in, a shift lever actuator carried by said plunger for axial movement therewith, said spring being disposed at least partially about said plunger and interposed between said actuator and a fixed part of said solenoid, said actuator having a pair of spaced transversely extending substantially parallel flat surfaces, a pivotally mounted shift lever one end of which is adapted to be coupled to said pinion, the opposite end of said shift lever having first and second opposed shift lever surfaces that respectively engage said surfaces on said actuator, said first surface being substantially flat and said second surface being curved, the actuator surfaces and the shift lever surfaces being substantially engaged when said shift lever is in an at rest position, the second surface on said shift lever being at greater radial distance from the pivot point of said shift lever than the radial distance of said first surface from said pivot point and being arranged relative to the surfaces on the actuator such that when said solenoid plunger pulls-in the second surface on the shift lever is moved by a surface of said actuator and the first surface on said shift lever becomes separated by a predetermined amount from its cooperating surface on said actuator, the amount of separation being sufficient to allow said solenoid switch to be actuated to an open condition when said solenoid coil winding is deenergized and said spring shifts said plunger to reengage the separated surfaces.

3. A shift lever mechanism for translating axial movement of the plunger of a starter solenoid into axial movement of a pinion of an engine starting apparatus comprising, a starter solenoid having an axially shiftable plunger, a coil winding and a solenoid switch operated to a closed condition when the plunger is completely pulled-in, a shift lever actuator, a retainer securing said shift lever actuator to one end of said plunger whereby said actuator moves axially with said plunger, said actuator having a pair of spaced surfaces that are located at different radial distances from the longitudinal axis of said plunger, a coil spring disposed at least partially about said plunger compressed between a fixed portion of said solenoid and said retainer opposing pull-in movement of said plunger, a pivotally mounted shift lever one end of which is adapted to be coupled to said pinion, the opposite end of said shift lever having a pair of opposed shift lever surfaces that respectively engage said surfaces on said actuator, the actuator surfaces and the shift lever surfaces being substantially engaged when said shift lever is in an at rest position, the surfaces on said shift lever being at different radial distances from the pivot point of said shift lever and being arranged relative to the surfaces on the actuator such that when said solenoid plunger pulls-in the surface on the shift lever that is at the greater radial distance from the pivot point is moved by a surface of said actuator and the other surface on said shift lever becomes separated by a predetermined amount from its cooperating surface on said actuator, the amount of separation being sufficient to allow said solenoid switch to be actuated to an open condition when said solenoid coil winding is deenergized and said spring shifts said plunger to reengage the separated surfaces.

4. A shift lever mechanism for translating axial shiftable movement of the plunger of a solenoid of an electrical engine starter into axial movement of a starter drive slidably supported by a shaft that is driven by a starter motor, the starter drive having a pinion movable with the starter drive that is shifted into and out of mesh with the ring gear of an engine comprising, a pivotally mounted shift lever pivoted about a pivot point, one end of the shift lever coupled to the starter drive such that pivotal movement of the shift lever causes the starter drive to move axially of said shaft, a solenoid including a solenoid coil and an axially shiftable plunger, said plunger being shiftable between a pulled-in position and a retracted at rest position, a solenoid switch operated to a closed condition by shiftable movement of said plunger to said pulled-in position, said switch being spring biased to an open condition, a spring urging said plunger toward said retracted position, a shift lever actuator connected to an end of said plunger having first and second opposed axially spaced shift lever actuating surfaces, the opposite end of said shift lever having third and fourth surfaces that are engaged respectively by said first and second surfaces of said actuator during movement of said plunger, said first surface engaging said third surface to pivot said lever in one direction to cause the pinion of the starter drive to move to a ring gear meshing position when said plunger moves toward said pulled-in position, said plunger in said pulled-in position closing said solenoid switch, said second surface engaging said fourth surface to pivot said shift lever in an opposite direction when the solenoid coil is deenergized and said plunger is being moved by the force of said spring toward said retracted position, said first and third and said second and fourth surfaces being substantially engaged when said plunger is fully retracted and said shift lever is in said at rest position, the distance between said pivot point and third surface being greater than the distance between said pivot point and said fourth surface whereby as said shift lever is pivoted in said one direction said fourth surface does not move as far in a direction parallel to the longitudinal axis of said plunger as said first and third surfaces and whereby said second and fourth surfaces become separated by a predetermined amount as said plunger is shifted to a pulled-in position, the amount of separation between said second and fourth surfaces being sufficient to permit said solenoid switch to open when said solenoid coil is deenergized and said spring moves the plunger to a position wherein said second and fourth surfaces become reengaged.

5. A shift lever mechanism for translating axial shiftable movement of the plunger of a solenoid of an electrical engine starter into axial movement of a starter drive slidably supported by a shaft that is driven by a starter motor, the starter drive having a pinion movable with the starter drive that is shifted into and out of mesh with the ring gear of an engine comprising, a pivotally mounted shift lever pivoted about a pivot point, one end of the shift lever coupled to the starter drive such that pivotal movement of the shift lever causes the starter drive to move axially of said shaft, a solenoid including a solenoid coil and an axially shiftable plunger, said plunger being shiftable between a pulled-in position and a retracted at rest position, a solenoid switch operated to a closed condition by shiftable movement of said plunger to said pulled-in position, said switch being spring biased to an open condition, a spring urging said plunger toward said retracted position, a shift lever actuator connected to an end of said plunger having first and second substantially parallel opposed axially spaced shift lever actuating surfaces, the opposite end of said shift lever having third and fourth surfaces that are engaged respectively by said first and second surfaces of said actuator during movement of said plunger, said third surface being curved and said fourth surface being substantially flat, said first surface engaging said third surface to pivot said lever in one direction to cause the pinion of the starter drive to move to a ring gear meshing position when said plunger moves toward said pulled-in position, said plunger in said pulled-in position closing said solenoid switch, said second surface engaging said fourth surface to pivot said shift lever in an opposite direction when the solenoid coil is deenergized and said plunger is being moved by the force of said spring toward said retracted position, said first and third and said second and fourth surfaces being substantially engaged when said plunger is fully retracted and said shift lever is in said at rest position, the distance between said pivot point and third surface being greater than the distance between said pivot point and said fourth surface whereby as said shift lever is pivoted in said one direction said fourth surface does not move as far in a direction parallel to the longitudinal axis of said plunger as said first and third surfaces and whereby said second and fourth surfaces become separated by a predetermined amount as said plunger is shifted to a pulled-in position, the amount of separation between said second and fourth surfaces being sufficient to permit said solenoid switch to open when said solenoid coil is deenergized and said spring moves the plunger to a position wherein said second and fourth surfaces become reengaged.

6. A shift lever mechanism for translating axial shiftable movement of the plunger of a solenoid of an electrical engine starter into axial movement of a starter drive slidably supported by a shaft that is driven by a starter motor, the starter drive having a pinion movable with the starter drive that is shifted into and out of mesh with the ring gear of an engine comprising, a pivotally mounted shift lever pivoted about a pivot point, one end of the shift lever coupled to the starter drive such that pivotal movement of the shift lever causes the starter drive to move axially of said shaft, a solenoid including a solenoid coil and an axially shiftable plunger, said plunger being shiftable between a pulled-in position and a retracted at rest position, a solenoid switch operated to a closed condition by shiftable movement of said plunger to said pulled-in position, said switch being spring biased to an open condition, a shift lever actuator connected to an end of said plunger having first and second substantially parallel opposed axially spaced shift lever actuating surfaces, a spring compressed between a fixed portion of said solenoid and said actuator urging said actuator and plunger toward a retracted position, the opposite end of said shift lever having third and fourth surfaces that are engaged respectively by said first and second surfaces of said actuator during movement of said plunger, said third surface being curved and said fourth surface being substantially flat, said first surface engaging said third surface to pivot said lever in one direction to cause the pinion of the starter drive to move to a ring gear meshing position when said plunger moves toward said pulled-in position, said plunger in said pulled-in position closing said solenoid switch, said second surface engaging said fourth surface to pivot said shift lever in an opposite direction when the solenoid coil is deenergized and said plunger is being moved by the force of said spring toward said retracted position, said first and third and said second and fourth surfaces being substantially engaged when said plunger is fully retracted and said shift lever is in said at rest position, the distance between said pivot point and the point of engagement of said first and third surfaces being greater than the distance between said pivot point and the point of engagement of said second and fourth surfaces whereby as said shift lever is pivoted in said one direction said fourth surface does not move as far in a direction parallel to the longitudinal axis of said plunger as said first and third surfaces and whereby said second and fourth surfaces become separated by a predetermined amount as said plunger is shifted to a pulled-in position, the amount of separation between said second and fourth surfaces being sufficient to permit said solenoid switch to open when said solenoid coil is deenergized and said spring moves the plunger to a position wherein said second and fourth surfaces become reengaged.

* * * * *